US008844063B2

(12) United States Patent
Newman

(10) Patent No.: US 8,844,063 B2
(45) Date of Patent: Sep. 30, 2014

(54) SPORTS SPECTATOR CATCHING AND HANDLING GLOVE

(71) Applicant: Robert Newman, Hampton Bays, NY (US)

(72) Inventor: Robert Newman, Hampton Bays, NY (US)

( * ) Notice: Subject to any disclaimer, the term of this patent is extended or adjusted under 35 U.S.C. 154(b) by 0 days.

(21) Appl. No.: 13/710,512

(22) Filed: Dec. 11, 2012

(65) Prior Publication Data

US 2013/0185838 A1 Jul. 25, 2013

Related U.S. Application Data

(60) Provisional application No. 61/590,158, filed on Jan. 24, 2012.

(51) Int. Cl.
*A41D 13/08* (2006.01)
*A63B 71/14* (2006.01)

(52) U.S. Cl.
USPC ..... 2/19

(58) Field of Classification Search
USPC ..... 2/19, 20; D29/115
See application file for complete search history.

(56) References Cited

U.S. PATENT DOCUMENTS 1,725,727 A * 8/1929 Armstrong ..... 2/19
2,521,488 A * 9/1950 Smith ..... 2/19
5,528,772 A * 6/1996 Cheek ..... 2/161.1
5,544,362 A 8/1996 Synek
5,592,688 A * 1/1997 LaRonge et al. ..... 2/19
5,636,381 A 6/1997 Brogden
5,717,994 A * 2/1998 Goldsmith ..... 2/19
6,219,844 B1 4/2001 Yamada
6,289,515 B1 9/2001 Fous
6,353,931 B1 * 3/2002 Gilligan et al. ..... 2/19
6,370,691 B2 * 4/2002 Park ..... 2/19
2004/0068777 A1 * 4/2004 Wheelington, II ..... 2/161.1
2004/0172735 A1 * 9/2004 Garland ..... 2/160
2005/0268366 A1 * 12/2005 Anderson ..... 2/19
2005/0268367 A1 * 12/2005 Kogawa et al. ..... 2/19
2008/0060115 A1 3/2008 Morris
2008/0235842 A1 * 10/2008 Patel et al. ..... 2/19
2008/0295212 A1 * 12/2008 Richard ..... 2/19

* cited by examiner

*Primary Examiner* — Shaun R Hurley
(74) *Attorney, Agent, or Firm* — Daniel Boudwin; Global Intellectual Propety Agency LLC

(57) ABSTRACT

Disclosed is a form-fitting glove and catching device that provides sports fans with a ready means to catch a ball entering the spectator seating area while not reducing the wearer's ability to handle items will the glove is worn. The device comprises a glove having a body region covering the palm region and backside region of the wearer's hand, a thumb portion, a forefinger portion and a plurality of shortened finger portions. Spanning between the thumb and forefinger portions is a mitt web material for accepting a baseball or similar sports ball therein. The palm region includes a layer of protective padding, while the base of the body region comprises an opening having a strap securement means. The mitt web is a woven or netted material being secured along its periphery to the exterior portion of the thumb portion and forefinger, or alternatively to the thumb portion and middle finger.

16 Claims, 3 Drawing Sheets

SPORTS SPECTATOR CATCHING AND HANDLING GLOVE

CROSS REFERENCE TO RELATED APPLICATION

This application claims the benefit of U.S. Provisional Application No. 61/590,158 filed on Jan. 24, 2012, entitled "Foul Ball." The above identified patent application is herein incorporated by reference in its entirety to provide continuity of disclosure.

BACKGROUND OF THE INVENTION

1. Field of the Invention

The present invention relates to ball catching mitts and baseball gloves. More specifically, the present invention relates to a sports spectator hand mitt for catching balls that enter the spectator section at a baseball game, while also accommodating the wearer's ability to handle objects with the gloved hand while donned.

Attending sporting events is a popular activity. Attending baseball games is a great pastime that allows fans to be very close to the playing field during game play, and in some circumstances, actually come into contact with the game ball as it leaves the park or is fouled out of play. Fans in certain seats must be vigilant during the game and during certain plays, as certain seats are more prone to receive fouled balls or balls that leave the field of play. The act of catching a fouled or homerun ball is sometimes a difficult task given the speed of the ball, the number of people in the stands vying for the ball, and the general lack of catching equipment for snaring the ball midair. A common sight is to see fans, both young and old, toting a baseball glove or catching mitt through the baseball stadium. For these fans, it is one of their goals to catch a ball that has left the field of play during the game and one that has actually been used during the game. This game-day souvenir may become a valued keepsake, and could potentially have real value depending on the type of play and the players involved with that ball during the game. A baseball glove allows a spectator to more readily catch the ball while protecting the fan's hand in the process.

The act of carrying and stowing a baseball glove as a spectator during a game can be a cumbersome task and an unwanted burden, however. This is particularly true for adult fans that may be less inclined to add articles to their person above what is necessary. A baseball glove is generally bulky and is not conducive to easy stowing or folding into a condensed state that would allow the wearer to leave it unattended or stow it in an article of clothing when not being deployed. The traditional baseball glove is bulky and limits the wearer's ability to handle objects with the gloved hand. People therefore grow tired of bringing such a glove to games on a consistent basis. Wearing the mitt can limit the amount of activities the fan can engage in with their hands, such as enjoying refreshments, beverages, celebrate and handle items with both hands.

To solve this well known problem and to provide spectators with a means of catching a foul ball or homerun ball without hindering the wearer's ability to handle items, the present invention is herein provided. It is submitted that this issue has long been neglected in the art, and a clear need arises for an article of hand wear that acts as a catching device and hand cover that does not detract from the wearer's ability to handle items during a game. Specifically, the present invention provides a formfitting hand glove that includes a palm-covering body region, a thumb portion, a forefinger portion, and a plurality of cut-off finger portions. Between the thumb portion and forefinger or middle finger portion is a small web or netting adapted to provide a basket or mitt within which to snare or catch a ball that enters the spectator stands area. The interior palm region is padded in case of palm impacts with the ball, while the body of the device is such that the wearer's fingers are not constricted from independent and free movement for grasping and manipulating items while the device is being worn. It is contemplated that the present invention may be purchased and brought into a baseball park by individual fans, or further handed out to young fans as a souvenir entering the ballpark during certain games.

2. Description of the Prior Art

Devices have been disclosed in the prior art that relate to hand covering and catching gloves. These include devices that have been patented and published in patent application publications. These generally relate to improved baseball gloves and protective hand coverings for various activities other than that contemplated by the present invention. The art fails to contemplate a wearable glove that is both a flexible hand covering and a catching device, wherein the elements of the catching web do not detract from the ability to handle objects freely with each gloved finger. The present device acts as a hybrid between a form-fitting glove and a baseball catching glove. The following is a list of devices deemed relevant to the present disclosure, which are herein described for the purposes of highlighting and differentiating the unique aspects of the present invention, and further highlighting the drawbacks existing in the prior art.

Specifically, U.S. Pat. No. 5,544,362 to Synek discloses a ball glove for use by young children that comprises a flexible reticulate web extending between a thumb and finger portion. The web includes a central patch spaced apart from the thumb and finger portions, while web filaments connect the patch to the glove body. The finger and thumb portions are positioned apart from one another, wherebetween an enlarge web is positioned. The Synek device is one that is centered on a large web for catching a ball and facilitating young wearer's ability to field a ball. This glove design provides no means of handling other objects while the glove is donned. Its structure and intent is significantly divergent from that of the present invention, which provides a readily wearable glove device for use when attending ball games, and one that does not shield one's fingers while donned.

Further, U.S. Pat. No. 5,636,381 to Brogden discloses a sports glove suited to be worn on a wearer's hand to improve handling of sports balls, wherein the glove includes a palm portion, partial finger portions and webbing between finger portions. The finger portions are sleeves to allow the ends of each finger and thumb to exit from the end of each portion, while webbing connects each finger portion together. The Brogden device, while disclosing a sports ball handling glove that is well suited for handling a basketball, fails to disclose the novel aspects of the present invention, which includes finger portions and a single webbing structure for catching out-of-play balls at a sporting event.

U.S. Pat. No. 6,289,515 to Fous discloses an ergonomic sports ball fielding glove having an outer shell with at least one finger portion, a thumb portion and a web joining the thumb and finger portions. The thumb portions and the opening for the hand within the mitt are angled and proportioned to provide an ergonomic glove that is still suitable for in-game use. Similar to the Brogden device, the Fous device provides a sporting good that is designed for use while undertaking the sport, as opposed to a glove designed for a sports fan enjoying the game and one wanting to both enjoy the experience and have an improved chance of capturing a nearby airborne ball during the course of the game. The present invention provides a glove that can be worn for leisure and utilized when necessary, not requiring the user to choose the pure utility of the glove over the ability to handle refreshments and other articles.

Finally, U.S. Published Patent Application Publication No. 2008/0060115 to Morris discloses a protective glove designed for baseball fans that form-fits to the wearer's hand. The device comprises a padded palm region having backside connecting straps and finger portions to connect to the wearer's fingers. The thumb of the user is free from covering and fits between the backside straps. It is stated that the goal of the Morris device is to provide a protective article while allowing the fan to easily enjoy food and beverages without removal of the glove. However, the Morris device is one that is merely a padded hand covering with finger holes. No mention is made of an improved means to catch a sports ball in the air, but only a means to protect the user's palm if he or she were to be able to catch the ball with no additional netting or pouch.

The present invention is a spectator glove for catching balls entering the stands region of a ballpark. The device is a hybrid catching and refreshment handling glove, whereby the elements of the glove allow individual movement of each finger and improved ability to catch fly balls entering the spectator stands in a ballpark. It is submitted that the construction and intent of the present invention substantially diverges in elements from the prior art, and consequently it is clear that there is a need in the art for an improvement to existing spectator catching glove devices. In this regard the instant invention substantially fulfills these needs.

SUMMARY OF THE INVENTION

In view of the foregoing disadvantages inherent in the known types of catching gloves now present in the prior art, the present invention provides a new hybrid spectator catching and handling glove, wherein the same can be utilized for providing convenience for the user when catching balls in the spectator section of a ballpark and allowing handling of objects with the gloved hand during the game.

It is therefore an object of the present invention to provide a new and improved spectator catching device that has all of the advantages of the prior art and none of the disadvantages.

It is another object of the present invention to provide a spectator catching device that is a compact, form-fitting means of catching a fly ball at a ballpark without limiting the user's ability to handle refreshments or stow the device on the wearer's person when not in use.

Another object of the present invention is to provide a spectator catching device that allows individual finger movement when worn and partial finger portions away from the catching web of the glove.

Yet another object of the present invention is to provide a spectator catching device that can be purchased by a spectator and brought into a ballpark for use catching balls entering the seating area and out of play.

Another object of the present invention is to provide a spectator catching device that can be provided as a souvenir and gift to entering fans of a ballpark for certain games.

A final object of the present invention is to provide a spectator catching glove of simple and robust construction, wherein the glove can be inexpensively produced and distributed for widespread sport spectator use at low cost.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
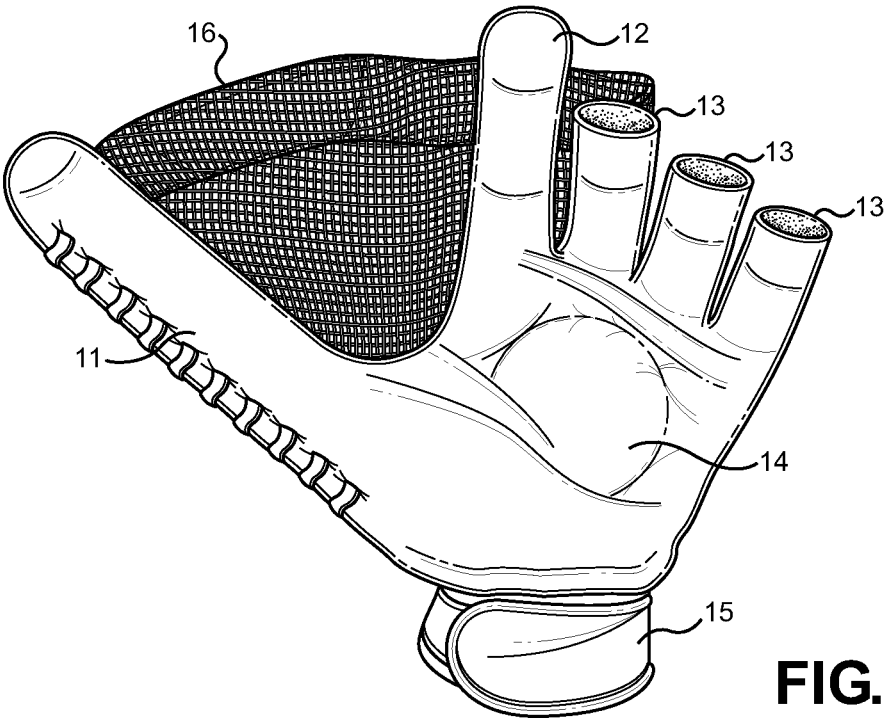
FIG. 1 shows a frontal view of the present invention.

Reference is made herein to the attached drawings. Like reference numerals are used throughout the drawings to depict like or similar elements of the spectator catching glove. For the purposes of presenting a brief and clear description of the present invention, the preferred embodiment will be discussed as used for providing a spectator with a fly ball catching device while facilitating refreshment handling. The figures are intended for representative purposes only and should not be considered to be limiting in any respect.

Referring now to FIG. 1, there is shown a front side view of the spectator catching glove of the present invention. This view highlights the interior or palm region of the glove and its configuration while deployed. The device comprises a hand covering glove having a body region, wherefrom a thumb portion 11, a forefinger portion 12 and a plurality of finger portions 13 extend therefrom. The body region includes a palm area 14 and a backside region defining an open interior, while a lower opening allows a user's hand to enter thereinto. The thumb portion 11 is an elongated thumb covering that covers a protects the entirety of a user's thumb and extends outwardly therefrom to provide an outer support for a web 16 that spans between the thumb portion 11 and one of the finger portions 12, 13. Similar to the thumb portion, the forefinger portion 12 is similarly a full-finger covering. Both of these structure bound the sides of the web 16, therefore complete coverage of the user's finger is desired to prevent injury to either the wearer's thumb or forefinger when catching a ball within the web 16. An alternate configuration provides a partially covered forefinger portion 12 that allows the wearer's index finger to protrude from the open end thereof. This embodiment allows greater dexterity and control of a handled object, but offers less in the way of covered protected from a ball being corralled within the web 16. Each of the finger portions 13 may be full fingered coverings, but it is preferred to offer partial finger portions 13 to allow the user to have improved feel and purchase over refreshments and other handled items while wearing the device.

The palm area 14 of the glove is an area that can be inadvertently used as a means to catch a fly ball during such an event. While the web 16 is designed to catch the ball, hurried motion or misjudgments can result in the ball impacting the wearer's palm. For this region, it is desired that the palm region first be provided a material covering to prevent direct contact, and further to supply a layer of padding along this area 14 to prevent inadvertent injury when catching a ball. While this is not required, padding may protect an exuberate spectator from harming him or herself in the act of catching a ball entering the spectator section of a ballpark.

Figure 2:
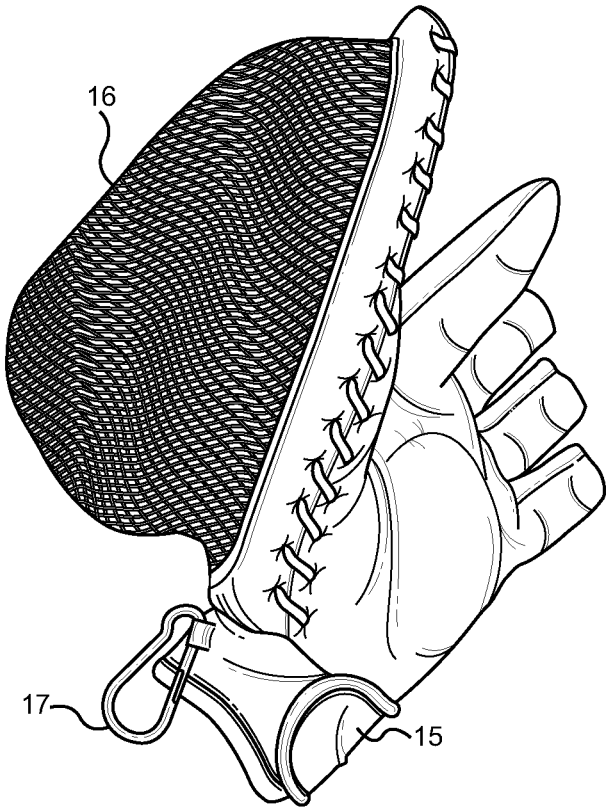
FIG. 2 shows a side view of the present invention.

Referring now to FIG. 2, there is shown a side view of the present invention. In this view, the size of the web 16 is highlighted to illustrate the improved means of catching a baseball provided by employing a web or netting material. The web 16 provides an increased area to catch an airborne ball, and allows the energy of the ball to be dissipated into the web rather than the user's palm region. The web 16 connects along a first edge along the elongated thumb portion, allowing the web to be sufficiently large to facilitate catching and to spread the load from an incoming ball along an extended length of stitching used to secure the web 16 to the thumb portion. While deployed, the user places his hand through the body portion lower opening and secures the opening with a supplied securement strap 15, which may include a patch of hook and loop fastening material or similar securement means to maintain compression on the wearer's wrist. A utility clip 17 is provided along the base of the device to allow the device to be attached to another article when not being deployed.

In an exemplary embodiment of the present invention, the thumb portion and outer finger portion may be adorned with enlarged lacing or stitching customarily found in the construction of a player's baseball glove. This lacing is purely decorative, adding very little to the structure of the device; however its inclusion adds visual appeal to the glove and further allows one to relate the device to the game of baseball. The lacing may be incorporated into the construction of the device as a means to secure the thumb portion and outer finger portion edges together, or may just overlay existing structural stitching and provide a purely ornamental addition.

Figure 3:
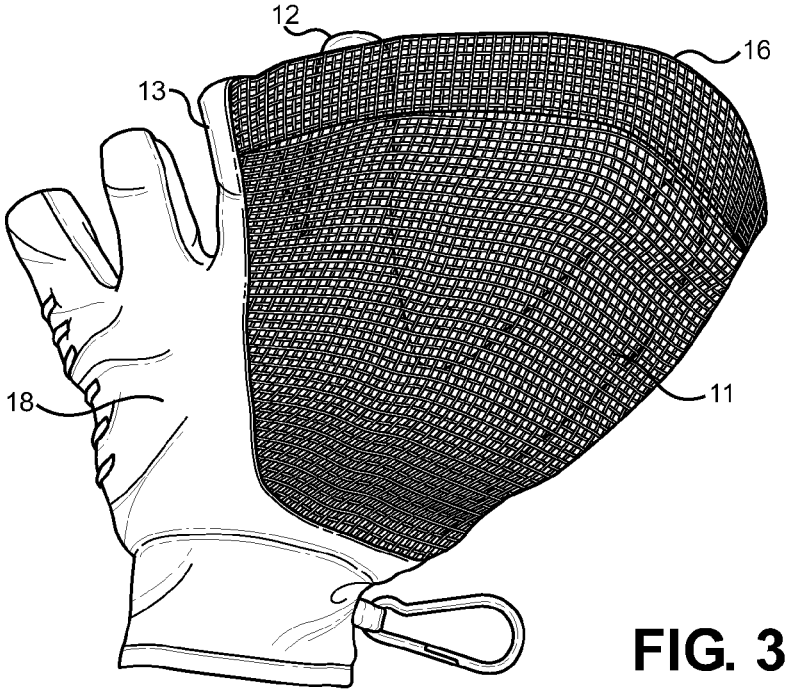
FIG. 3 shows a backside view of the present invention.

Referring now to FIG. 3, there is shown a backside view of the present invention in a deployed state. In this view, the connection of the web 16 to the glove is visualized, whereby its lower periphery establishes a line of connection that is secured to the backside surface 18 of the glove, along the thumb portion 11 and along one of the finger 13 or forefinger 12 portions. This line of connection establishes the base and periphery of an enclosed pocket or web for a ball to rest within, while the upper portion of the web comprises an unsupported bridge region similar to that found on a traditional baseball glove. The web 16 itself comprises a woven, laced or netting material that includes perforations or apertures therethrough, similar to a catching net or baseball glove web. It is contemplated that this web 16 can be comprised of a uniform or continuous material, however in a preferred embodiment the web 16 is a mesh or netting material that conforms around a caught baseball and provides a means to accept and attenuate the energy of an incoming ball. It is not desired to limit the material of either of the web 16 or the glove construction to a specific material, but rather it is desired to disclose a combination of elements that provide a user with a means to catch fly balls at a ball park while also facilitating handling of refreshment materials. The wearer's hand is therefore not to be restricted while the present invention is donned.

Figure 4:
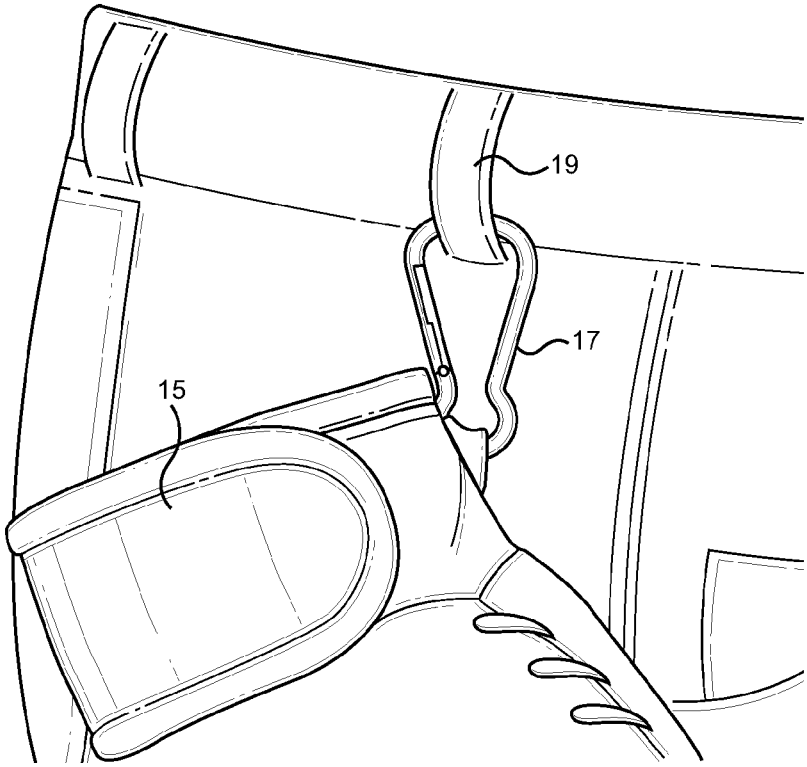
FIG. 4 shows the present invention stowed and connected to a wearer's person when not in use.

Referring now to FIG. 4, there is shown a view of the present invention in a stowed state, wherein the device is removed from a wearer's hand and connected to a carrying loop or clothing article for transport with physically handling of the device. The glove of the present invention is designed to provide a user with the ability to be readily stowed when not in use. This includes being able to fold or condense on itself, and further to connect of the device to a wearer's person or luggage article. In FIG. 4, the supplied utility clip 17 is utilized to connect the glove by its lower portion 15 to the belt loop 19 of a user. This allows the user to transport or carry the device without holding the glove or taking up space within a carry bag.

Figure 5:
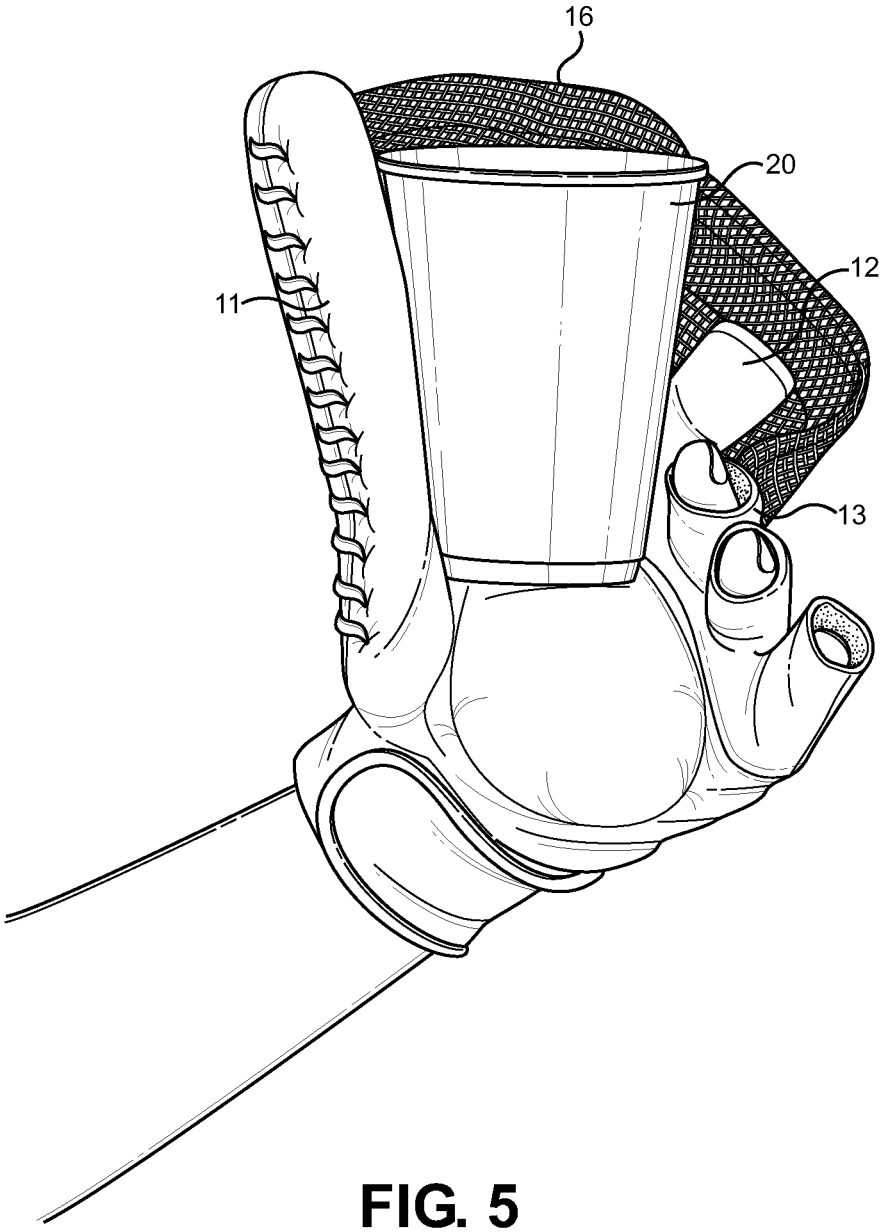
FIG. 5 shows a view of the present invention in use handling a refreshment item.

Referring finally to FIG. 5, there is shown a view of the present spectator glove of the present invention in a working state, secured to a wearer's hand while the wearer is handling a beverage refreshment 20. The independent fingers 13, 12 of the glove allow the wearer to grasp items 20 between the opposing thumb 11 as normally conducted when not wearing the glove. The web 16 placement and structure is such that it does not interfere with the thumb 11 or finger portions 12, 13 during this operation. This allows a wearer to enjoy a baseball game, handle refreshments and continuously wear the catching glove device in the event of a ball entering the user's region. The ability to continuously wear the device increases the likelihood that a fan or spectator will be able to catch a fly ball, and will prevent the wear from frequently removing it due to discomfort or interference with other items.

The present invention describes a ball catching glove for fans and spectators, and one that can be enjoyed by young fans and adults alike. It is contemplated that such a device can be adorned with a specific team or brand logo and sold to fans, or likewise be distributed at the gates of a ballpark for use during the event. The device comprises a glove having three fingertip cutouts for the middle, ring, and little finger, a flexible web that extends from the thumb to the middle or forefinger finger, and a shock absorbing cushion on the palm of the hand. The construction of the glove preferably comprises a continuous palm and interior thumb and finger portion that is connected to a backside hand, thumb and finger region along common edges. The thumb portion edge and the outer finger edge may further include decorative or structural glove lacing that is found on most player gloves. The glove additionally includes an adjustable securement strap at its base for securing around the wearer's wrist, and a utility clip for attaching the device to a support. The present invention can be used at baseball parks and stadiums to catch foul balls in the spectator areas. This device can also be ideal when holding a drink, food or similar refreshment, as the fan does not require removal of the glove handle such items.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A catching and handling glove, comprising:

a body region, a thumb portion and a plurality of finger portions;

a web having a free bridge portion and a line of connection securing between said thumb portion and a finger portion;

wherein said web line of connection secures along a second finger portion adjacent to said thumb portion, which defines a middle finger portion.

2. The glove of claim 1, wherein:

said body region further comprises a palm area, a backside portion and an open base defining an interior volume adapted to accept a user's hand therethrough.

3. The glove of claim 1, wherein:

said body region further comprises an open base having a securement means for compressing a wearer's wrist.

4. The glove of claim 1, wherein said body region further comprises a padded palm area.

5. The glove of claim 1, wherein said thumb portion further comprises an elongated covering over a wearer's entire thumb and supporting said web therealong.

6. The glove of claim 1, wherein said finger portion adjacent to said thumb portion defines a forefinger covering comprising an elongated covering over a wearer's entire forefinger.

7. A catching and handling glove, comprising:

a body region, a thumb portion and a plurality of finger portions;

a web having a free bridge portion and a line of connection securing between said thumb portion and a finger portion;

wherein said finger portion adjacent to said thumb portion defines a forefinger portion comprising an elongated covering over a wearer's entire forefinger, said web line of connection securing along said forefinger portion;

wherein said finger portions are disconnected from one another to promote freedom of movement.

8. The glove of claim 1, wherein said finger portions comprise a partial covering over a wearer's fingers and terminate at an opening.

9. The glove of claim 1, wherein said finger portions are disconnected from one another to promote freedom of movement.

10. The glove of claim 1, further comprising a stitched lacing along said thumb portion exterior edge.

11. The glove of claim 1, further comprising a stitched lacing along an outer most finger edge opposite of said thumb portion.

12. The glove of claim 1, wherein said body region further comprises a utility clip for securing said glove to a support when stowed.

13. The glove of claim 7, wherein said finger portions comprise a partial covering over a wearer's fingers and terminate at an opening.

14. The glove of claim 7, wherein said thumb portion further comprises an elongated covering over a wearer's entire thumb and supporting said web therealong.

15. The glove of claim 7, said body region further comprises an open base having a securement means for compressing a wearer's wrist.

16. The glove of claim 7, wherein said body region further comprises a utility clip for securing said glove to a support when stowed.

* * * * *